US008381912B2

(12) United States Patent
Dalhamer

(10) Patent No.: US 8,381,912 B2
(45) Date of Patent: Feb. 26, 2013

(54) TRAY FOR RETAINING FOOD ITEMS DURING TRANSPORTATION

(76) Inventor: Coni Dalhamer, Beavercreek, OH (US)

( * ) Notice: Subject to any disclaimer, the term of this patent is extended or adjusted under 35 U.S.C. 154(b) by 261 days.

(21) Appl. No.: 12/787,491

(22) Filed: May 26, 2010

(65) Prior Publication Data

US 2011/0290697 A1 Dec. 1, 2011

(51) Int. Cl.
*B65D 1/34* (2006.01)

(52) U.S. Cl. ..... 206/557; 206/560; 220/574

(58) Field of Classification Search ..... 206/501, 206/504, 505, 507, 541, 546, 549, 557, 821, 206/560; 220/23.83, 23.87, 574; 294/144, 294/172; 426/115, 120
See application file for complete search history.

(56) References Cited

U.S. PATENT DOCUMENTS 1,334,342 A * 3/1920 Woods ..... 220/737
1,673,703 A * 6/1928 Orman ..... 220/627
2,732,696 A * 1/1956 Woods ..... 99/446
3,025,948 A * 3/1962 Appelt ..... 206/546
3,508,183 A 4/1970 Pinkard
3,610,459 A 10/1971 Hansen
3,643,812 A * 2/1972 Mander et al. ..... 211/74
3,989,158 A * 11/1976 Florian ..... 220/23.83
4,239,230 A 12/1980 Shoptaugh
4,802,593 A 2/1989 Romanos
4,908,066 A 3/1990 Taylor et al.
5,055,081 A 10/1991 Nayak
5,097,957 A 3/1992 Adams et al.
5,139,166 A * 8/1992 Smith ..... 220/574
5,269,447 A 12/1993 Gower et al.
5,586,800 A 12/1996 Triplett
5,762,245 A 6/1998 Hurst
5,878,672 A 3/1999 Ostermann et al.
5,915,561 A 6/1999 Lorenzana et al.
5,975,628 A 11/1999 Russell
6,164,044 A * 12/2000 Porfano et al. ..... 422/28
6,179,377 B1 1/2001 Harper
6,315,126 B1 11/2001 Cornelissen
6,533,133 B2 * 3/2003 Liu ..... 211/74
7,267,244 B1 * 9/2007 Dalhamer ..... 220/574
8,157,090 B2 * 4/2012 Ingvardsen et al. ..... 206/562
2002/0108880 A1 * 8/2002 Krupa et al. ..... 206/497
2004/0144683 A1 7/2004 Wang
2006/0272979 A1 * 12/2006 Lubbers et al. ..... 206/557

* cited by examiner

*Primary Examiner* — Luan K Bui
(74) *Attorney, Agent, or Firm* — R. William Graham

(57) ABSTRACT

A tray for retaining food items during transportation includes a lower deck having a base and a side wall extending about and upward from a perimeter of the base; an upper deck which includes a plurality of apertures spatially positioned across the deck, the upper deck configured to fit within the lower deck and removably disposed thereon; and a plurality of pegs, each peg configured to friction fit within at least one of the apertures to be retained therein.

10 Claims, 8 Drawing Sheets

TRAY FOR RETAINING FOOD ITEMS DURING TRANSPORTATION

BACKGROUND OF THE INVENTION

1. Field of the Invention

The present invention relates to trays for food. More particularly, the invention relates to a tray for retaining food items during transportation.

2. Related Art

Food trays are commonly used at social functions where food is served, such as parties and receptions. At gatherings where family and friends are asked to bring a dish of food, these dishes vary in content of solids and liquids. In either case, the transportation of such foods in a vehicle to and from the gathering can be difficult. Dishes are commonly placed in the floor board of the vehicle and have a tendency to slide around during transport resulting many times in spilling of the contents into the vehicle. Moreover, many of the food items/containers are hot. Consequently, transporting these to and from the automobile requires handling with hot pads and/or mittens.

Prior to the inventor's recent invention, attempts to prevent this from occurring include surrounding the food container with towels or other items to prevent the food container from sliding around on the floor board. Also, cargo retainers in the rear of vehicles, such as the trunk, were used to retain cargo within a predefined space within the retainer.

Some food trays of the prior art incorporate a flat surface portion and a cup-like portion formed in the upper surface of the plate for supporting both food and a drink container. Although the plates of this type are capable of supporting a drink container and some type of food container, they are not designed for transportation of various configured containers in a suitable manner to prevent spillage from occurring as a result of lateral G-forces acting on the transported food container.

The inventor's prior invention was an attempt to provide a solution to the problem by providing a pegboard tray for retaining food items during transportation. While this was an improvement, there remains a need to aid one in transporting food items within a container from one's kitchen to a vehicle. Further, there is a need for a suitable transportation device for food containers which can be readily inserted and removed from one's vehicle. There is a further need that such a device be aesthetically pleasing. The present invention aims to solve these needs.

SUMMARY OF THE INVENTION

Therefore, it is an object of the present invention to provide a transportable food tray that overcomes the deficiencies present in the prior art.

It is another object of the invention to provide a transportable food tray capable of transporting a food container in a manner which prevents lateral movement thereof when disposed on the tray.

It is still another object of the invention to provide a transportable food tray that can be easily and comfortably transported by an individual with a food container disposed thereon to and from a vehicle.

It is yet another object of the invention to provide a transportable food tray which is aesthetically pleasing.

A further object is to provide a tray which can be readily cleaned.

Still another object is to provide a tray which includes multiple decks.

Other objects and advantages will be readily apparent to those skilled in the art upon viewing the drawings and reading the detailed description hereafter.

Accordingly, the present invention is directed to a tray. The tray includes a lower deck having a base and a side wall extending about and upward from a perimeter of the base; and an upper deck which includes a plurality of apertures spatially positioned across the deck, the upper deck configured to fit within the lower deck and removably disposed thereon. The tray also includes a plurality of pegs, each peg configured to friction fit within at least one of the apertures to be retained therein.

The apertures extend through the upper deck to permit fluid communication from the top of the upper deck to the lower deck. The lower deck has at least one handle extending laterally outward from the side walls. The upper deck has a pair of opposing handles to enable easy removal from the lower deck. The upper deck can be configured with a depth less than a height of the side wall, wherein the upper deck is configured such that with the apertures therein provides a sufficient distance between a top surface of the upper deck and said lower deck to enable to heat to dissipate therebetween. The upper deck has a top surface for supporting a dish therein wherein the pegs can be positioned within the apertures to retain the dish in a manner to prevent lateral movement thereof.

BRIEF DESCRIPTION OF THE DRAWINGS

FIG. 8 is an exploded side view illustrating the invention.

DETAILED DESCRIPTION OF THE INVENTION

Figure 1:
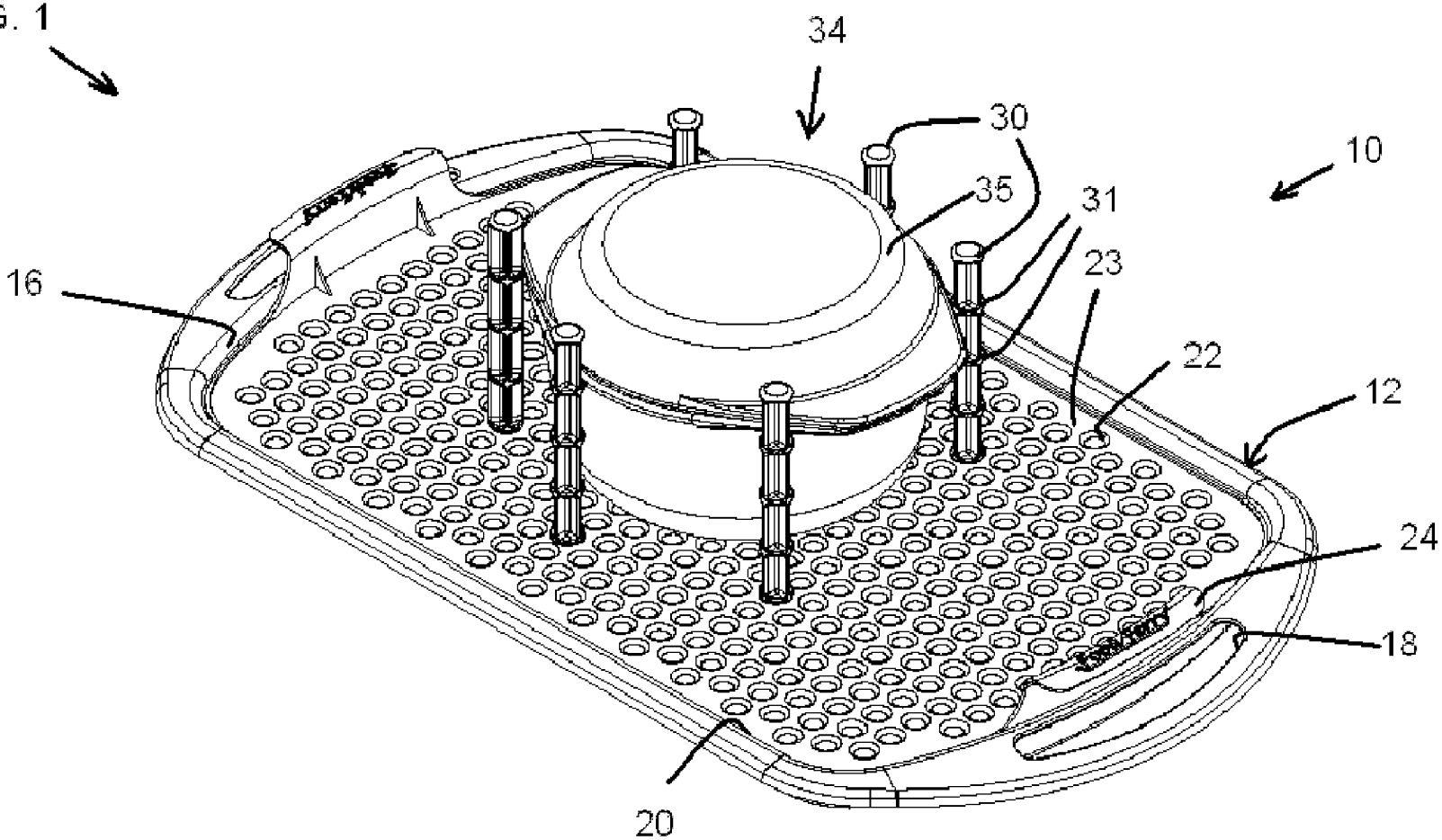
FIG. 1 is a perspective view of a tray the present invention in use.
Figure 2:
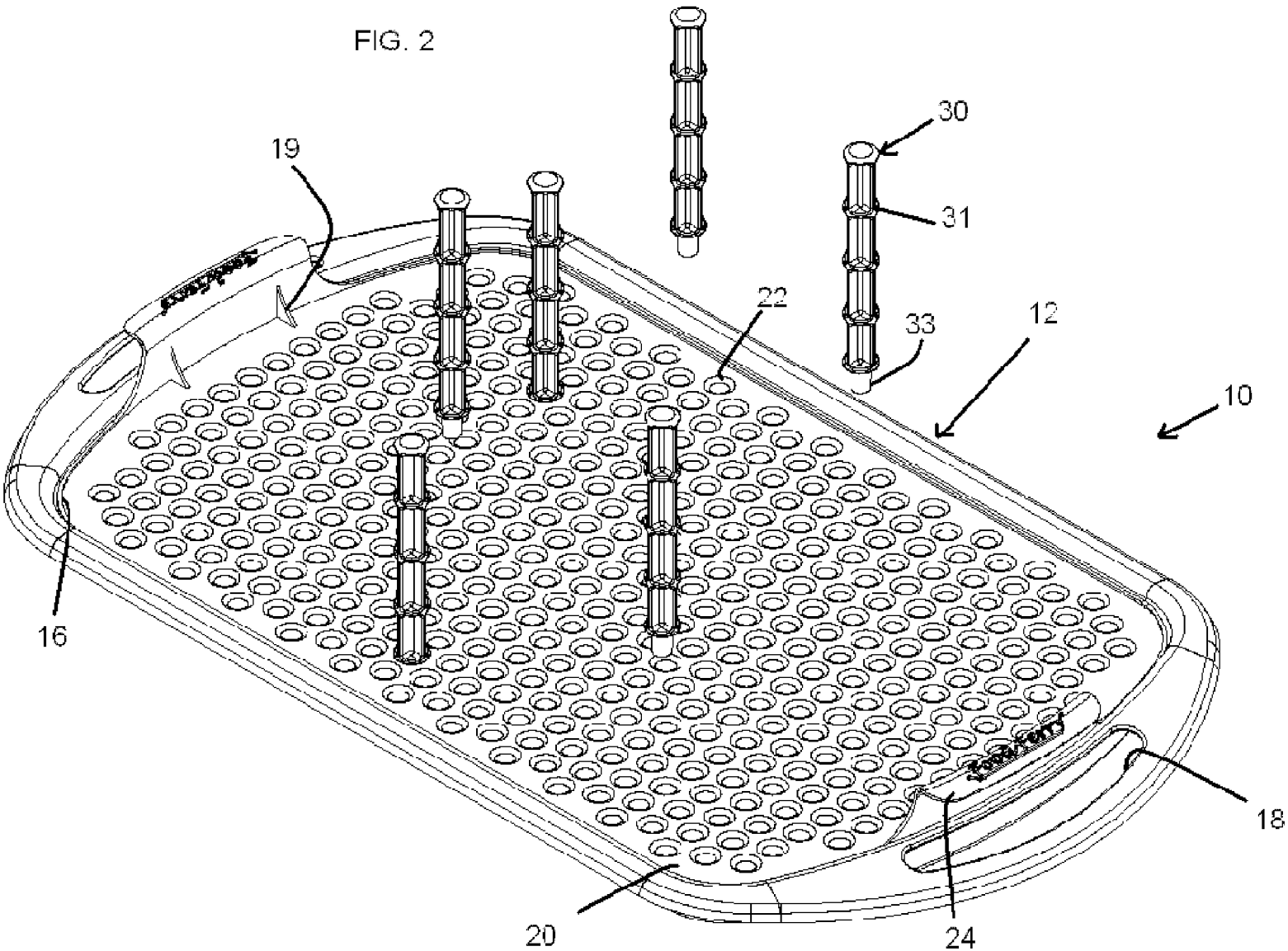
FIG. 2 is a perspective view of a tray the present invention.
Figure 3:
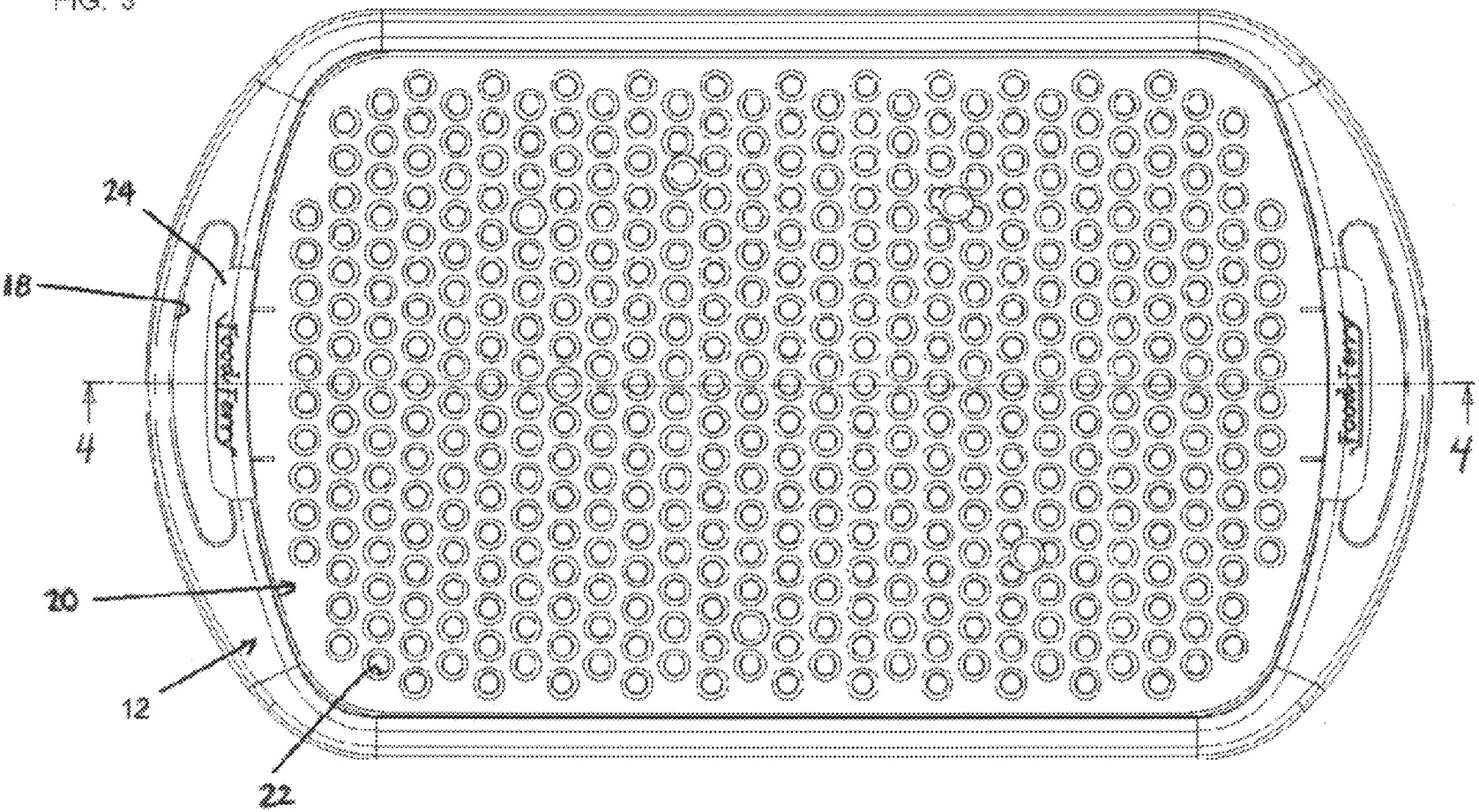
FIG. 3 is a top view of part of the present invention.
Figure 4:
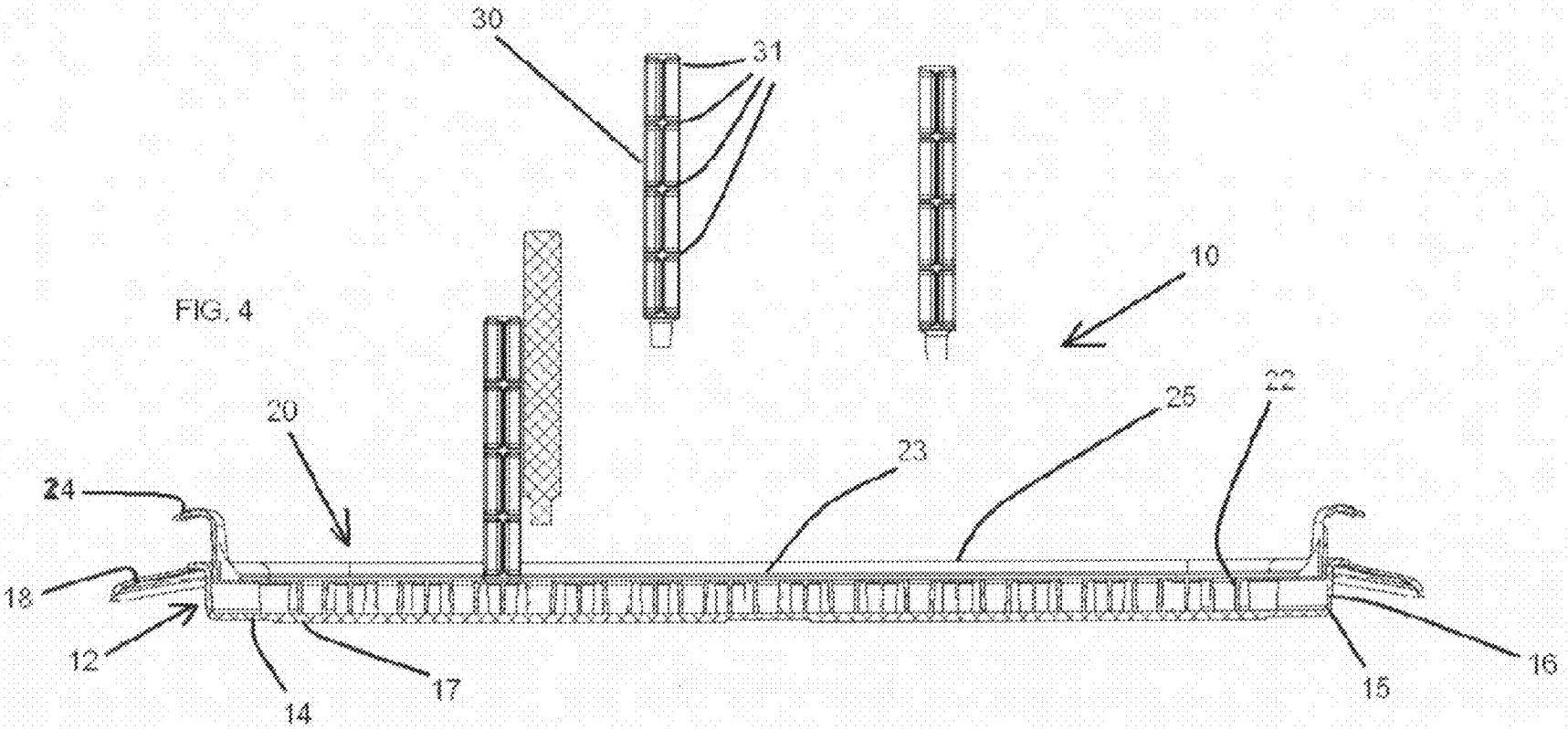
FIG. 4 is a cross-sectional view of the present invention through line 4-4 in FIG. 3.
Figure 5:
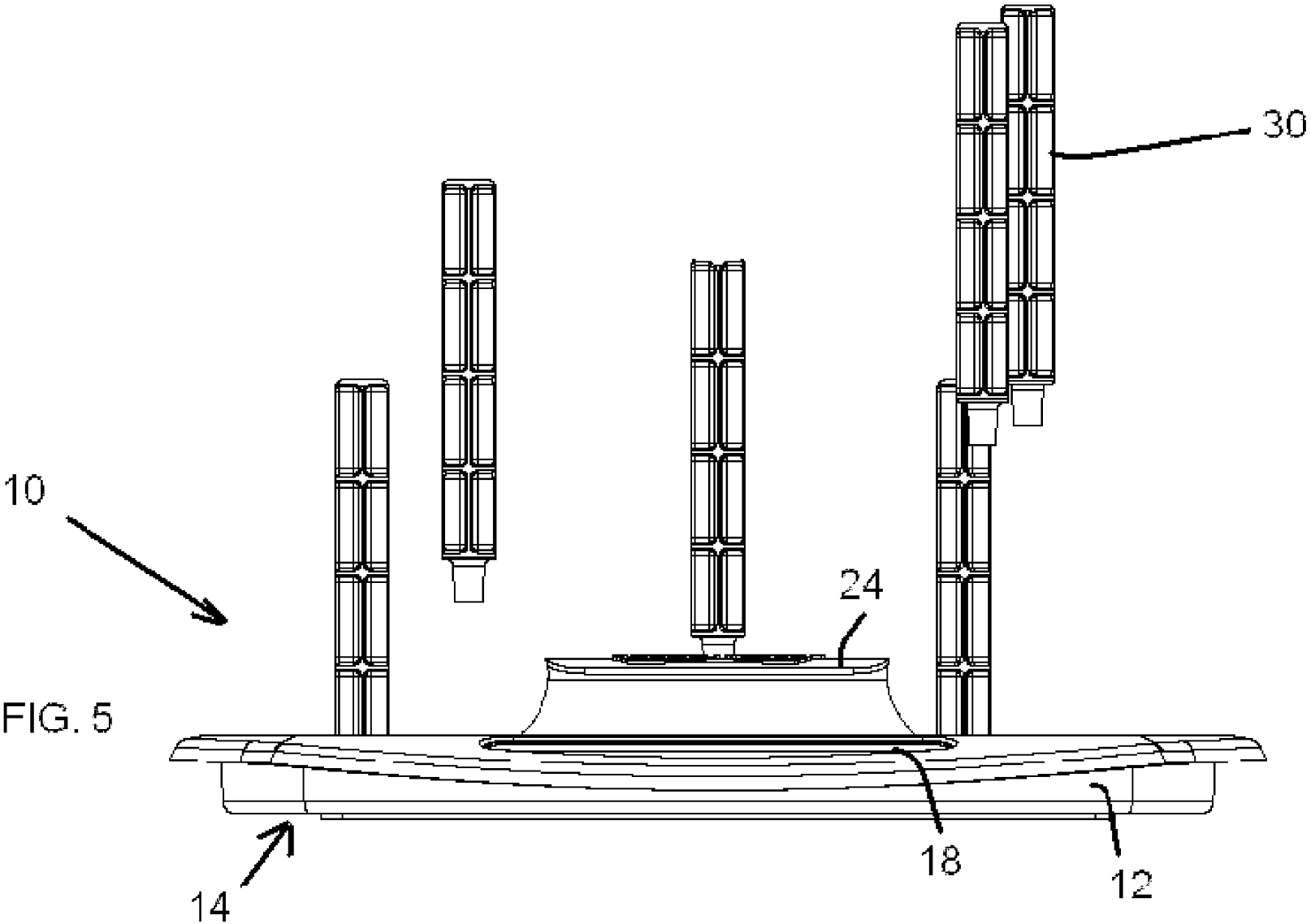
FIG. 5 is an end view of the invention.
Figure 6:
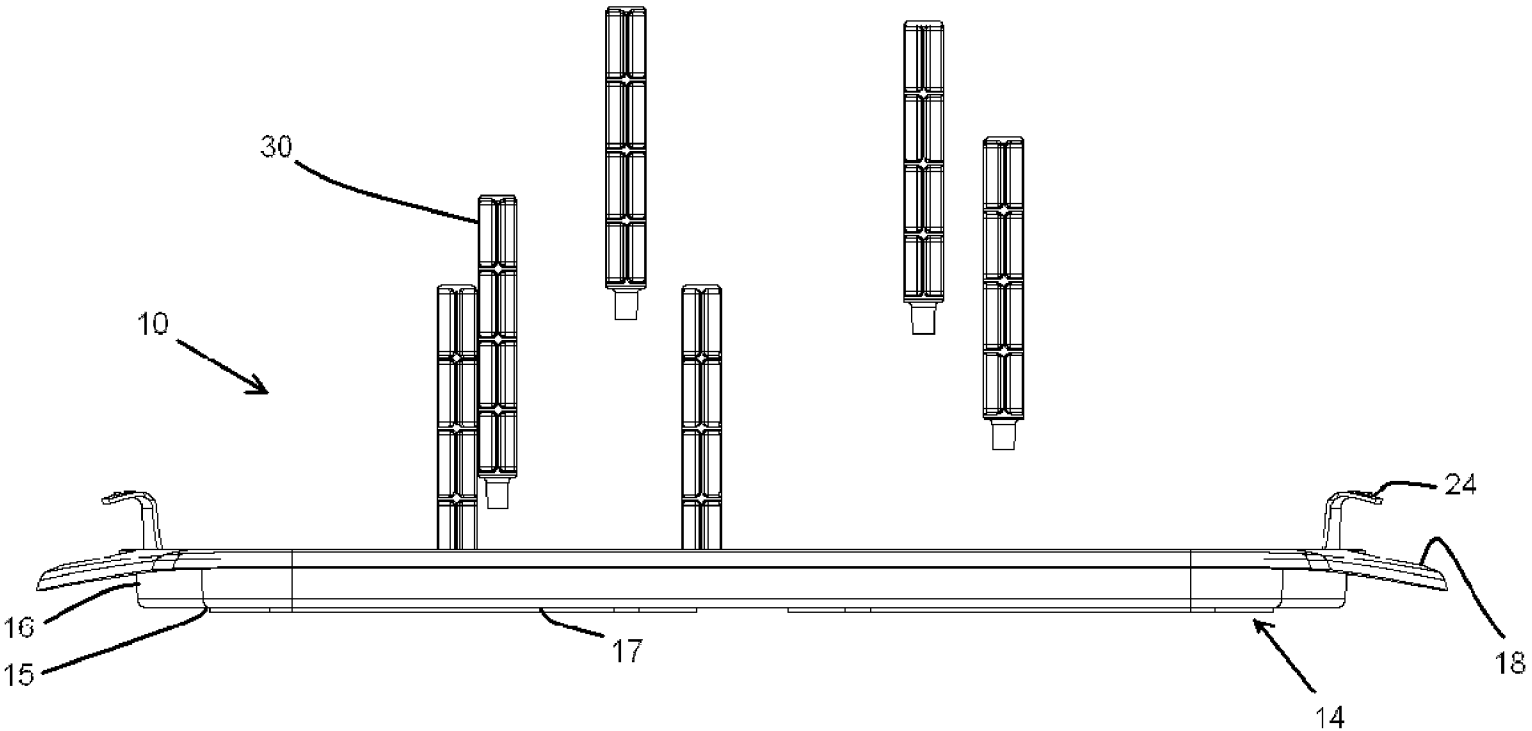
FIG. 6 is a side view of the invention.
Figure 7:
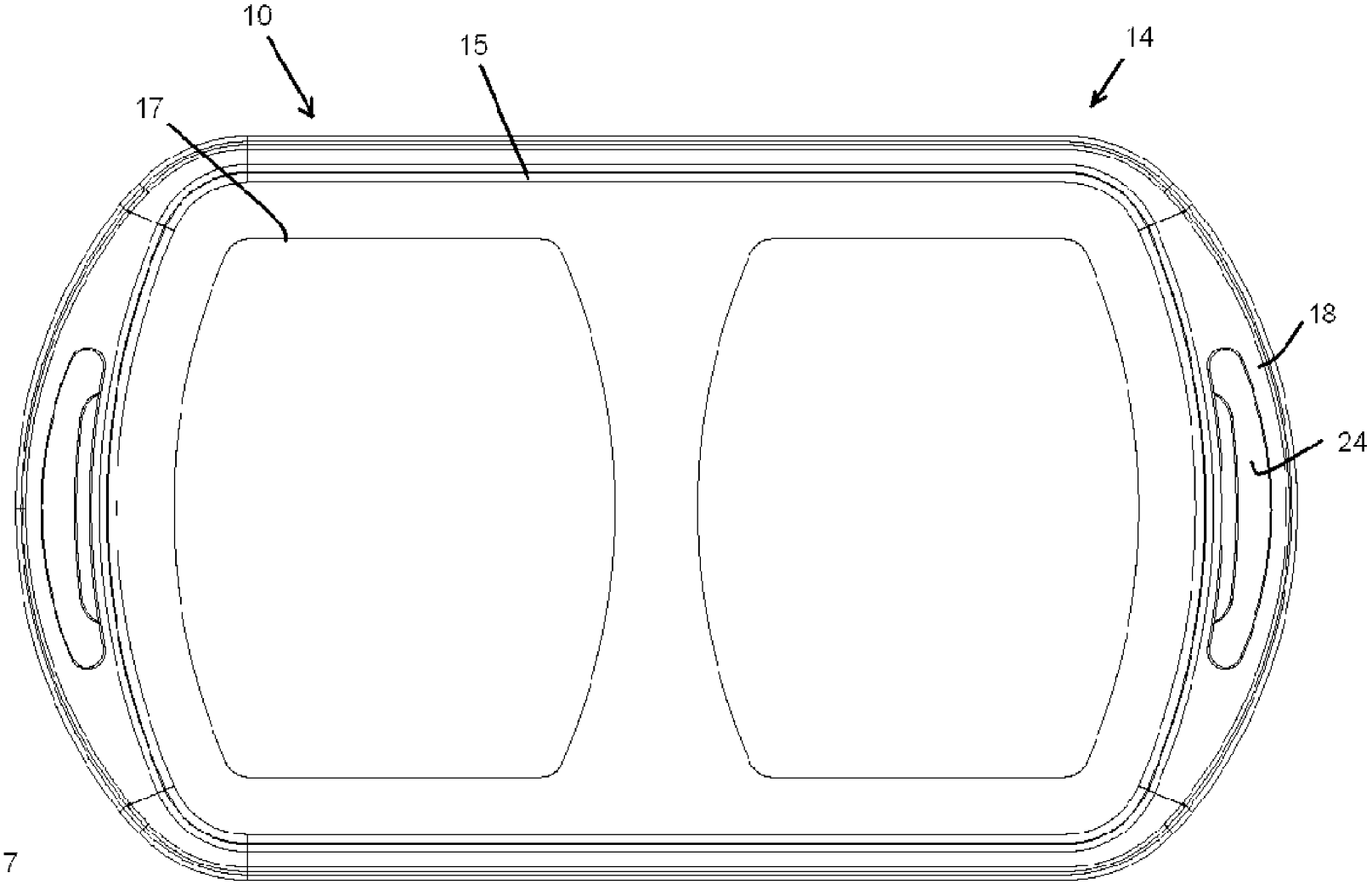
FIG. 7 is a bottom view of the invention.
Figure 6:
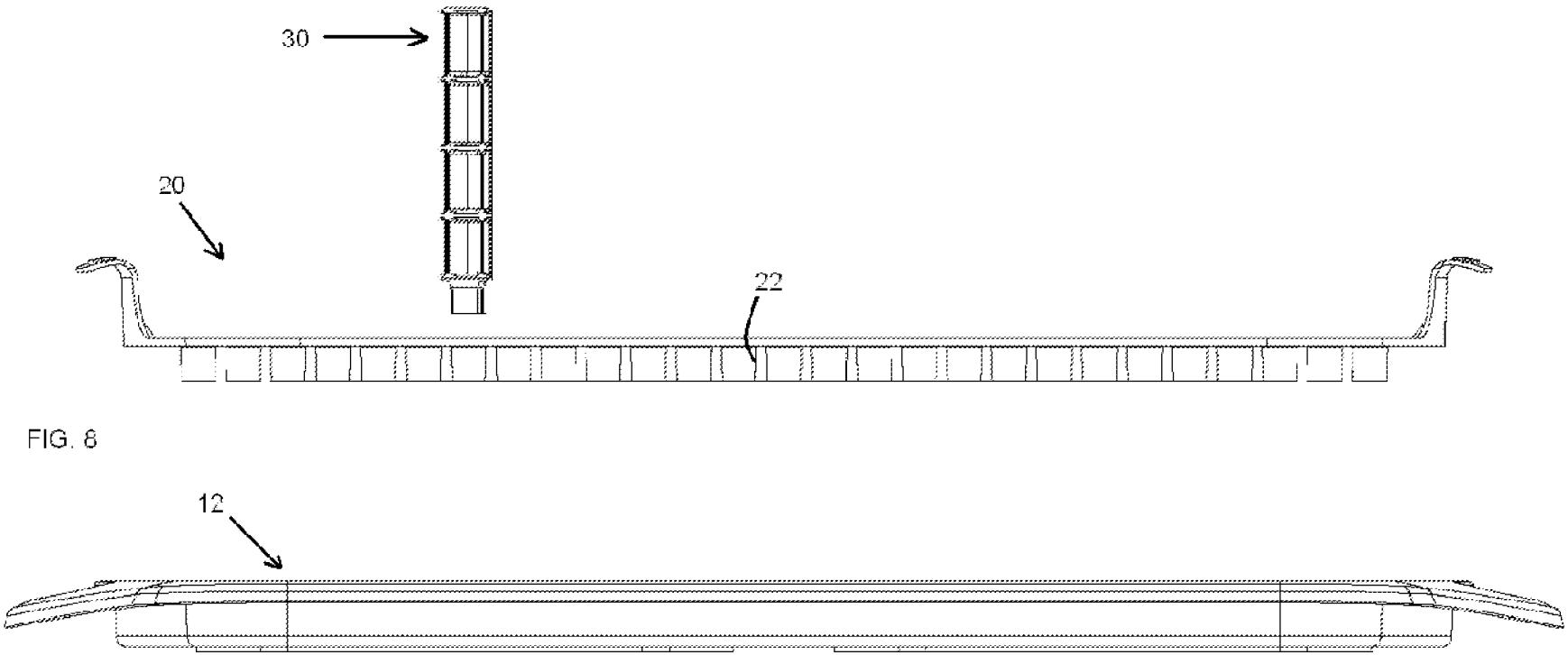

Referring now to the drawings, the tray for retaining food items during transportation is generally designated by the numeral 10. The tray 10 has a lower deck 12 having a base 14 and side walls 16 extending about and upward from a perimeter of the base 14. The lower deck 12 has a pair of handles 18 extending laterally outward from the side walls 16.

The tray 10 has an upper deck 20 which includes a plurality of individually defined aperture surfaces having a wall surface an opening therethrough hereinafter referred to as apertures 22 spatially positioned across the upper deck 20 and which communicate with a top surface 23 of the upper deck 20 and extend separately downwardly out from the upper deck 20 a predetermined length providing a continuous open area around and between the apertures 22. The apertures 22 thus extend through the upper deck 20 to permit fluid communication from a top surface 23 of the upper deck 20 to the lower deck 12 and about the individual apertures 22. This also permits easy cleaning of the upper deck 20 should there be a spill. The upper deck 20 is configured to fit within the lower deck 12 and be removably disposed thereon. The upper deck 20 has a pair of opposing handles 24 which extend upward and outward from the top surface 23 of the upper deck 20 and to enable easy removal from the lower deck 12 in an unrestricted vertical manner relative to a horizontal plane H of the lower deck 12. The upper deck 20 includes support angles 19 which lend structural support between upper deck 20 and handles 24. The tray 10 also includes a plurality of pegs 30, each peg 30 configured with a lower portion and an upper portion, where a lower part of the lower portion is friction fit within one of the apertures 22 to be retained therein and a part of the upper portion is of a larger diameter than aperture 22 and a majority of the length each peg 30 extends above the aperture 22 when the lower part is fit within the aperture 22 and thus once inserted will stay until manually removed.

The apertures 22 are spatially positioned in the top surface 23 to accommodate various shaped food containers 34 to be operatively disposed thereon and retained by pegs 30. The apertures 20 are oriented in at least three or more equally spaced diagonal rows and wherein the rows substantially span the top surface 23 to provide the apertures 22 adjacent and about the food containers 34.

The upper deck 20 is configured with a depth less than a height of the side walls 16 of the lower deck 12. The top surface 23 of the upper deck 20 supports food container 34 therein wherein the pegs 30 can be positioned within the apertures 22 to retain the food container 34 in a manner to prevent lateral movement thereof.

The top surface 23 can include an anti-slip surface 25 which can be made of a rubber material, for example, and adhered to or otherwise formed thereto. In this regard a bottom surface 15 of lower deck 12 can include an anti-slip surface 17 which can be made of a rubber material, for example, and adhered to or otherwise formed thereto. The anti-slip surface 17 can include cavities to receive complementary formed The pegs 30 are configured with an end 33 to friction fit within the apertures 22. The pegs 30 are of a sufficient height such that when inserted into apertures 22 about food container 34, for example, they retain the container 34 in a manner to prevent lateral movement thereof with respect to the top surface 23. In other words, the containers 34 do not tend slide or tip on the top surface 23. Further, the pegs 30 can be of a sufficient height to extend to at least meet an associated lid 35 of the container 34. Similarly, the pegs 30 prevent the lid 35 from sliding or coming ajar from the container 34 during transport. Containers and lids made of glass, ceramic, Pyrex™ or other cookware material which are often inherently made of slippery surfaces and when transported, particularly via a vehicle, will tend to slide or tip when undergoing lateral G-forces.

As seen in the figures, when the pegs 30 are inserted in the tray 10, for example, include a plurality of vertically spaced horizontal ribs 31. In this way, pegs 30 thus each have an upper portion and a lower portion, the lower portion being friction fit into the apertures 22 and said upper portion being configured with several enlarged cross section (ribs 31) which individually can extend over the container 34 to retain against a top side of thereof. The pegs 30 may be easier to insert and remove with the aid of ribs 31. Another function of the ribs 31 can be to extend over an edge of the lid 35 to further aid in preventing the lid 35 from coming ajar as might be the case when transporting in a vehicle and going over a bump. By adding a plurality of spaced ribs 31, this also enables retention of lids for various height containers 34.

The apertures 22 and given thickness of the upper deck which can be of about an inch, for example, provide an insulation feature to permit dissipation of heat between the decks 12 and 20. The tray 10 and pegs 30 can be made of polymer, metal or plastic, other material which is designed to withstand high heat and cold temperatures.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A tray, which comprises:

a lower deck having a base and a side wall extending about and upward from a perimeter of said base; and an upper deck which includes a plurality of apertures spatially positioned across said upper deck and which communicate with a top surface of said upper deck and extend separately downwardly out from said upper deck a predetermined length providing a continuous open area around and between said apertures, said apertures are a length approximate a length of said side wall of said lower deck, said upper deck and apertures configured to fit within said lower deck and removably disposed thereon and in a manner to readily permit removal from said lower deck in an unrestricted vertical manner relative to a horizontal plane of said lower deck; and a plurality of pegs, each peg configured with a lower portion and an upper portion, where a lower part of said lower portion is friction fit within at least one of said apertures to be retained therein and a part of said upper portion is of a larger diameter than said one aperture and a majority of the length each peg extends above said aperture when said lower part is fit within said aperture.

2. The tray of claim 1, wherein said apertures extend through said upper deck to permit fluid communication from a top of said upper deck to said lower deck.

3. The tray of claim 1, wherein said lower deck having at least one handle extending laterally outward from said side wall.

4. The tray of claim 3, wherein said upper deck has a pair of opposing handles to enable easy removal from said lower deck.

5. The tray of claim 1, wherein said upper deck is configured such that with said apertures therein provides a sufficient distance between a top surface of said upper deck and said lower deck to enable to heat to dissipate therebetween.

6. The tray of claim 1, wherein said upper deck has a top surface for supporting a dish therein wherein said pegs can be positioned within said apertures to retain said dish in a manner to prevent lateral movement thereof.

7. The tray of claim 6, wherein said top surface includes an anti-slip surface.

8. The tray of claim 1, wherein a bottom surface of said lower deck has an anti-slip surface.

9. The tray of claim 1, wherein said lower deck has a pair of handles extending from said side wall.

10. The tray of claim 1, wherein said apertures are oriented in at least three equally spaced diagonal rows and wherein said rows substantially span a top surface of said upper deck to provide said apertures adjacent and about a food container, wherein each peg is removably disposed one said aperture about the food container and wherein said pegs cooperate with each other in a manner to prevent the food container from moving laterally on said base support surface, and said upper portion being configured with a plurality of enlarged cross sections which can extend over to retain against a top side of the food container.

* * * * *